US005569495A

United States Patent [19]

Evans et al.

[11] Patent Number: 5,569,495

[45] Date of Patent: Oct. 29, 1996

[54] METHOD OF MAKING VARISTOR CHIP WITH ETCHING TO REMOVE DAMAGED SURFACES

[75] Inventors: Anthony C. Evans, Woodside, Calif.; Takeshi Tsukada, Asaka Saitama, Japan; Shukri J. Souri, Mountain View; Ryan W. Dupon, San Carlos, both of Calif.

[73] Assignee: Raychem Corporation, Menlo Park, Calif.

[21] Appl. No.: 441,891

[22] Filed: May 16, 1995

[51] Int. Cl.[6] ..... B05D 5/12

[52] U.S. Cl. ..... 427/446; 427/101; 427/282; 427/294; 427/309; 427/343

[58] Field of Search ..... 427/446, 309, 427/294, 101, 282, 343

[56] References Cited

U.S. PATENT DOCUMENTS

| | | | |
|---|---|---|---|
| 3,496,512 | 2/1970 | Matsuoka et al. | 338/20 |
| 3,886,097 | 5/1975 | Hossenlop . | |
| 4,032,965 | 6/1977 | Cline et al. | 357/76 |
| 4,094,061 | 6/1978 | Gupta et al. | 29/612 |
| 4,148,135 | 4/1979 | Sakshaug et al. | 29/621 |
| 4,180,483 | 12/1979 | Ho et al. | 252/518 |
| 4,184,984 | 1/1980 | Levinson | 252/518 |
| 4,319,215 | 3/1982 | Yamazaki et al. | 338/21 |
| 4,364,021 | 12/1982 | Levinson | 338/20 |
| 4,551,268 | 11/1985 | Eda et al. | 252/519 |
| 4,959,262 | 9/1990 | Charles et al. | 428/329 |
| 5,039,452 | 8/1991 | Thompson et al. | 252/518 |
| 5,155,464 | 10/1992 | Cowman et al. | 338/21 |

FOREIGN PATENT DOCUMENTS

| | | |
|---|---|---|
| 60-926 | 8/1985 | Japan . |
| 4-003647 | 1/1992 | Japan . |

OTHER PUBLICATIONS

Sonder et al., "ZnO Varistors Made from Powders Produced Using a Urea Process," Am. Ceram. Soc. Bull. 64(4), 665–068 (1985) (no month date).

Derwent abstract No. 85–052103/09 (abstract of JP 60/007704 (Matsushita Elec. Ind.) (1985) (no month date).

*Primary Examiner*—Katherine Bareford

*Attorney, Agent, or Firm*—Herbert G. Burkard; Yuan Chao

[57] ABSTRACT

A method of making varistor chips is disclosed. A workpiece of varistor material is sliced into slices of varistor material. The slices are in turn diced to make the varistor chips. The chips are etched in an etchant such as dilute citric acid to remove from their surfaces varistor material damaged during the slicing and/or dicing operations. Otherwise, the damaged varistor material adversely affects the leakage current characteristics of the varistor chips.

11 Claims, 1 Drawing Sheet

METHOD OF MAKING VARISTOR CHIP WITH ETCHING TO REMOVE DAMAGED SURFACES

TECHNICAL FIELD OF THE INVENTION

This invention relates to a method of making varistor chips.

BACKGROUND OF THE INVENTION

A varistor (also known as a non-linear resistor) has nonlinear electrical properties—in particular, it exhibits a nonlinear voltage-current behavior. Below a critical voltage (also variously referred to as the breakdown voltage, the switching voltage, or the threshold voltage) a varistor is highly resistive, in the megohm range, and acts essentially as an insulator, allowing only a small leakage current to pass through it. When the breakdown voltage is exceeded, the resistance of the varistor decreases dramatically, and the varistor conducts substantial amounts of current—i.e., acts as a conductor. The voltage-current relationship of a varistor is described by the equation $$I=(V/C)^{\alpha}$$

where I is the current flowing through the varistor; V is the voltage across the varistor; C is a constant which is a function of the dimensions, composition, and method of fabrication of the varistor; and $\alpha$ (alpha) is a constant which is a measure of the nonlinearity of the varistor. A large $\alpha$, signifying a large degree of nonlinearity, is desirable. High quality varistors typically have an $\alpha$ greater than 20, as high as 50 or above.

One common application for a varistor is a surge arrester. In a surge arrester, the varistor is connected in series between an electrical system and ground. At ordinary system voltages, the varistor is highly resistive, so only a leakage current flows between the system and ground. If there is a sudden surge in the system voltage, exceeding the breakdown voltage (for example because of a lightning strike), the varistor becomes conductive and shunts the excess current to ground. This way, the system voltage is prevented from exceeding a predetermined maximum voltage above which damage to system components could occur. Systems so protected by varistors can range in size from a power distribution network to an individual electronic device, such as a computer, a television set, and the like.

Another application for a varistor is as an element for controlling the switching of pixels of liquid crystal displays. See, for example, Raychem, WO 92/18972 (1992).

The size of the varistor element in a surge arrester varies in accordance with the size of the system protected and the desired switching voltage. In particular, the switching voltage is directly related to the thickness of the varistor element across which the current is to pass. For some systems, the varistor element may be quite small, for example a chip only tenths of millimeters thick and only several millimeters wide and long. One way to produce small varistor chips is to make a tape of varistor material and dice it into appropriately sized chips. However, because of variations in the thickness of varistor tape, the thickness of the varistor chips and hence their switching voltage are subject to undesirable variations from chip to chip. Thus, a method of reliably making varistor chips of known dimensions and switching characteristics is desirable.

SUMMARY OF THE INVENTION

This invention provides a method of making varistor chips, comprising the steps of:

(a) providing a workpiece of varistor material;

(b) slicing the workpiece into a plurality of slices of varistor material;

(c) dicing the slices into a plurality of varistor chips; and (d) etching the chips with an etchant to remove varistor material damaged during the slicing and/or etching steps.

BRIEF DESCRIPTION OF THE DRAWING(S)

FIG. 1 shows schematically the process of this invention.

DESCRIPTION OF THE PREFERRED EMBODIMENTS

Figure 1:
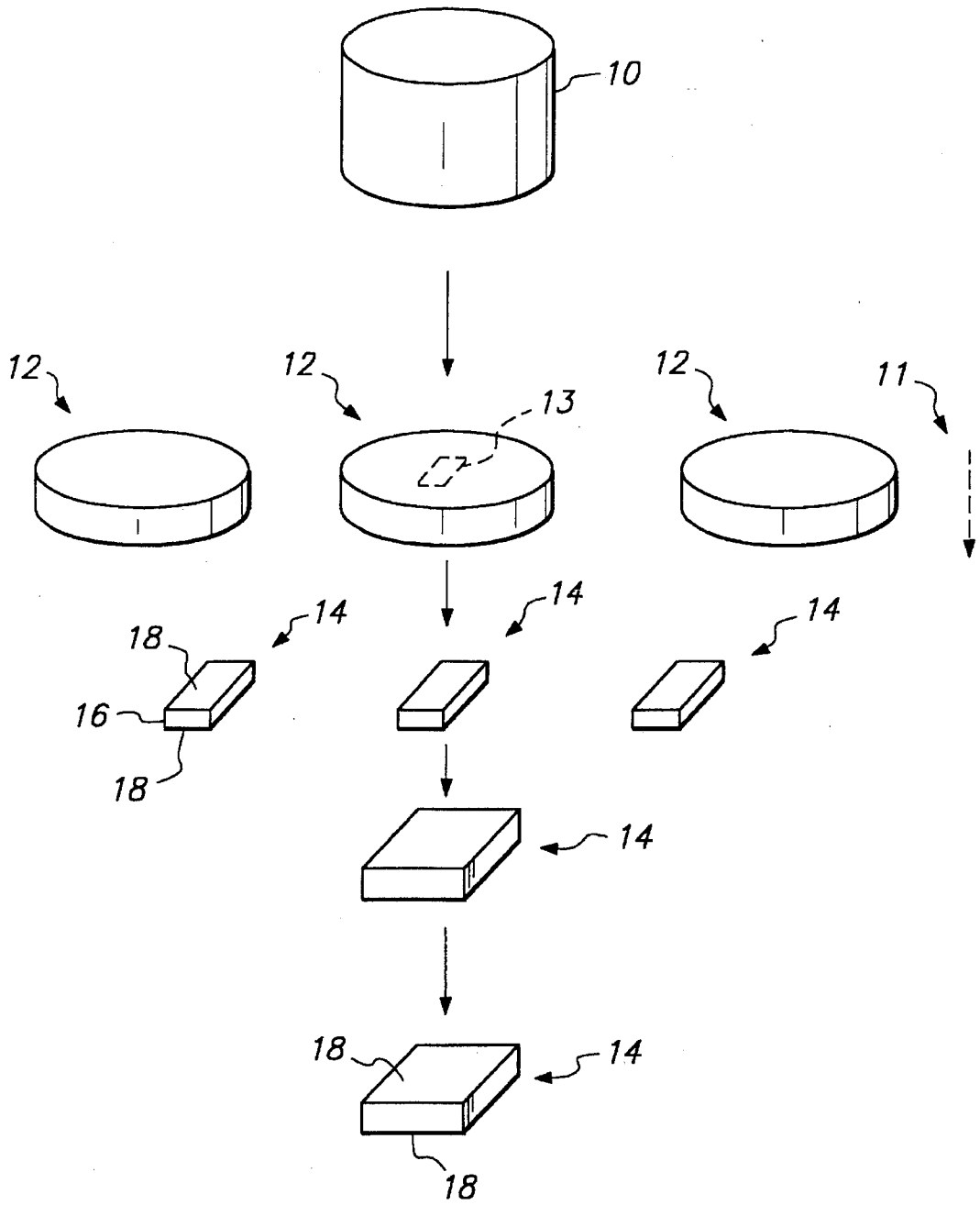

We have discovered that the process of this invention enables the mass production of consistent high quality varistor chips with very little specimen-to-specimen variation in their electrical characteristics. Varistors can be obtained which have a variation of ±2% in their switching voltage at a normalized current density of 1 mAmp/cm$^2$. The variation is so small that the switching voltage of chips can be accurately "dialed in," that is, predicted in advance by setting the process parameters appropriately, instead of relying on trial-and-error. The amenability of the present process to efficient mass production—with minimal batch-to-batch variations—also enables the production of low cost varistor chips.

A common varistor material is a polycrystalline sintered ceramic of zinc oxide (the primary metal oxide) containing additionally minor amounts of oxides of other metals (the additive metal oxides) such as $Al_2O_3$, $B_2O_3$, BaO, $Bi_2O_3$, CaO, CoO, $Co_3O_4$, $Cr_2O_3$, FeO, $In_2O_3$, $K_2O$, MgO, $Mn_2O_3$, $Mn_3O_4$, $MnO_2$, NiO, PbO, $Pr_2O_3$, $Sb_2O_3$, $SiO_2$, SnO, $SnO_2$, SrO, $Ta_2O_5$, $TiO_2$, or mixtures thereof.

In a preferred method for making varistor materials for use in this invention, soluble salt precursors of the additive metal oxides are converted to the respective oxides and hydroxides in the presence of zinc oxide powder by a precipitant, commonly ammonium hydroxide. Preferably, the additive metal oxides or their precursors are combined with the zinc oxide, and then the precipitant is added to the mixture, although the reversed mixing sequence may also be used. The additive metal oxides precipitate onto or around the zinc oxide, to form a precursor powder which is an intimate mixture of zinc oxide and the additive metal oxides. The precursor powder is collected, dried, and formed into a desired shape (the green body) and sintered at an elevated temperature (typically 1000°–1400° C.) to develop the characteristic polycrystalline microstructure responsible for the varistor properties. During the sintering, any hydroxides are converted to the corresponding oxides. Eda et al., Japanese laid-open application no. 56-101711 (1981) and Thompson et al., U.S. Pat. No. 5,039,452 (1991), the disclosure of which is incorporated herein by reference, disclose suitable precipitation processes.

Other disclosures relating varistor materials which may be used include Matsuoka et al., U.S. Pat. No. 3,496,512 (1970); Eda et al., U.S. Pat. No. 4,551,268 (1985); and Levinson, U.S. Pat. No. 4,184,984 (1980). Additionally, varistor materials based on materials other than zinc oxide may also be used, for example silicon carbide, titanium oxide, strontium oxide, or strontium titanate varistors.

The workpiece is typically elongate in shape, for example a rod or thick disk between 28 and 300 mm in diameter. The cross-sectional shape is normally circular, but other shapes are not excluded. The workpiece may be formed by cold or hot isostatic pressing, uniaxial pressing, or extrusion, among other techniques. The workpiece is sliced into varistor slices. The slicing may be performed with equipment of the type used in the semiconductor industry to slice silicon and quartz crystals. We have sliced disks 42 mm diameter×30 mm thick on equipment manufactured by Ceratec (Japan) using multiple parallel steel saw blades. Each blade was separated from the next by spacers, with multiple slices being obtained at one time. Water or oil with a polishing lubricant such as green carbide is sprinkled from above to the contact area between the blade and the workpiece. Slices as thin as 0.2 mm were obtained, with excellent parallelism and smooth surface.

Equipment from other sources, using diamond or tungsten carbide coated blades may also be employed. In one embodiment, an "ID Slicer" machine from Silicon Technology Corporation, N.J., in which the slicing is done with the inside diameter (edge) of an annular saw blade, was used. A very thin annular ring of stainless steel is coated on its inside diamter with a diamond abrasive to make the saw blade. Such blades are available in many thicknesses and diameters, with a range of abrasive grits. The blade is stretched radially by draw bolts connected to a ring of holes on the outside circumference of the blade. The draw bolts also form the means for attaching the blade to a cutting head which is rotated by an electric motor. The workpiece is mounted on a sacrificial beam (usually graphite) and then translated through the hole in the blade by means of a precise feed system. Once the workpiece has been moved into position (inside the hole), the cutting head is lowered onto the work to begin the slicing. The blade is passed through the workpiece to complete the slice. The cutting head is retracted and the work is translated forward and the process is repeated. Slicing precision is controlled by: the precision of the translational feed system and its ability to properly position the workpiece for the required thickness of cut; by the precision of the mechanism that moves the cutting head; and the precision of the blade position within the head as it slices.

After slicing, the slices of varistor material are diced to produce individual chips. Saws of the type used from the slicing step may be used. Automatic dicing saws such as 300 series equipment from DISCO may be used. After scribing, the slices are snapped into the individual chips. Alternatively, instead of scribing and snapping, direct dicing into chips may be done.

Typical chip sizes are a few millimeters wide and long, by a few tenths to a few millimeters thick, for example 5×5×0.8 mm (for surface mount applications) or 2×2×4 mm (for leaded applications). Generally, the chips are between 0.3 and 6 mm in thickness. We have discovered that the leakage current of the chips as diced (about $1\times10^{-5}$ amp/cm$^2$) was 2 to 3 orders of magnitude greater than that of the varistor slices (about $5\times10^{-8}$ amp/cm$^2$). Without being bound by any theory, we believe that the mechanical action of dicing damages the chip surfaces in the direction parallel to current conduction. The damaged surface affects the conduction mechanism there, and, hence, the leakage current.

We have further discovered that the leakage current can be reduced to very close to its pre-slicing value by etching away the damaged surfaces, that is, to about $1\times10^{-7}$ amp/cm$^2$. The etching may be done by immersing the chips in a dilute acid, for example in 5% by weight aqueous citric acid for 30 min at 40° C. Other suitable etchants include dilute solutions of protonic or oxo acids such as nitric, acetic, hydrochloric, perchloric, sulfuric, succinic, ethylene diamine tetraacetic (EDTA), oxalic, and the like. A preferred type of acid is an acid which is capable of forming metal complexes. Ordinarily, the concentration of the etchant acid is between 0.05 and 10 N, with 0.1 and 1 N being preferred. The etching time is typically between 0.25 and 2 hr, and the temperature between 20° and 60° C. Those skilled in the art will appreciate that the selection of one particular parameter will affect the other parameters—for example, if a stronger or more concentrated etchant or higher temperature is selected, the etching time can be reduced correspondingly.

Alternatively, the etchant may be an alkali, such as dilute sodium or potassium hydroxide in about the same concentrations as stated above for the the acidic etchants. The etching time and temperature are generally within the same range given above, albeit on the longer and/or higher portion of the range.

The etching process typically removes a surface thickness of about 10–30 μm, with 20±5 μm being preferred. Alternatively, the thickness removed may be stated relative to the average grain size, in which instance the removal of a thickness equal to the average grain size is preferred. The switching voltage is then minimally affected by removal of material from the laminar (major) surfaces (thus reducing the thickness of the varistor and the current path length). If too much material is removed, the switching voltage would be affected. Conversely, if insufficient material is removed, the high leakage current defect is not corrected. Where the laminar surfaces are electroded prior to etching (see below), normally no laminar surface material is removed.

After etching, the chips may be electroded on their laminar surfaces for the attachment of electrical leads. Electroding may be done by plasma spraying a conductor (e.g., aluminum), silk screening a conductive ink (e.g., silver ink), or vacuum depositing a conductor. Alternatively, the electroding may be performed before before the dicing step, as it is more practical to electrode the larger, undiced slices than to individually electrode many small chips. A mild etchant such as citric acid does not appear to corrode or otherwise detrimentally affect electrode material such as silver glass. However, if etching is allowed to proceed for too long, some undercutting of the electrode material and removal of the underlying varistor material may occur, leading to delamination of the electrode material.

The above process steps are summarized in FIG. 1. A workpiece 10 of varistor material is sliced into plural slices 12 of varistor material. Each slice 12 is in turn diced into plural chips 14. (It is to be understood that the relative sizes of workpiece 10, slices 12, and chips 14 are not to scale. Also, the thickness of chips 14 is greatly exaggerated for clarity.) In the dicing step the slices are cut generally along the direction indicated by arrow 11. (For greater clarity, an outline 13 of a chip is shown on one of slices 12.) As a result of the mechanical action of dicing, surface varistor material along lateral edges 16 of chips 14 is damaged. During the etching step, the damaged surface material is removed, along with an inconsequential amount of surface material from laminar surfaces 18. The etched chips 14 can then be electroded on laminar surface 18 so that electrical contacts can be made. Depending on the manner of intended end use, one or both laminar surfaces 18 may be electroded, entirely or partially. (For convenience, the electroding step is depicted as being performed after the etching step. As noted above, this is not an obligatory sequence.)

The varistor chips made according to this invention can be used as circuit protection (surge arrester) elements for protecting electronic devices such as televisions, computers, telephones, stereo equipment, and the like from voltage surges. They be mounted in a surface mount configuration, which offers the advantage of compactness, or they can be leaded. Or they can be used as voltage reference devices.

EXAMPLE 1

Varistor chips with a nominal swtiching voltage of 600 V were sliced and diced from a varistor workpiece prepared by a precipitation process as described in the aforementioned U.S. Pat. No. 5,039,452. Three 5×5×3.3 mm chips were electroded with silver glass by Heraeus and then etched in 2.5% aqueous citric acid at 50° C. Results are provided in Tables I through III following.

TABLE I

Effect of Etching Time on Alpha

| Etching Time | Alpha (α) | | |
|---|---|---|---|
| (min) | Sample 1 | Sample 2 | Sample 3 |
| 0 | 50 | 61 | 60 |
| 6 | 59 | 56 | 57 |
| 10 | 63 | 54 | 58 |
| 15 | 63 | 62 | 60 |

TABLE II

Effect of Etching Time on Switching Voltage

| Etching Time | Switching Voltage (V) | | |
|---|---|---|---|
| (min) | Sample 1 | Sample 2 | Sample 3 |
| 0 | 595.40 | 593.00 | 593.60 |
| 6 | 600.22 | 598.05 | 598.44 |
| 10 | 602.11 | 596.97 | 597.83 |
| 15 | 601.07 | 600.54 | 599.94 |

TABLE III

Effect of Etching Time on Leakage Current

| Etching Time | Leakage Current (μamp/cm$^2$) | | | | | |
|---|---|---|---|---|---|---|
| | Sample 1 | | Sample 2 | | Sample 3 | |
| (min) | 80%[a] | 50%[a] | 80%[a] | 50%[a] | 80%[a] | 50%[a] |
| 0 | 5.67 | 0.878 | 6.10 | 0.924 | 6.00 | 0.932 |
| 6 | 0.726 | 0.0680 | 0.779 | 0.0693 | 0.728 | 0.0659 |
| 10 | 0.510 | 0.0498 | 0.527 | 0.0489 | 0.515 | 0.0484 |
| 15 | 0.481 | 0.0486 | 0.515 | 0.0471 | 0.502 | 0.0473 |

[a]At percentage of nominal switching voltage indicated

EXAMPLE 2

Varistors were etched with dilute sodium hydroxide (NaOH) solution of the same concentration and under the same conditions as for the citric acid in Example 1. The NaOH etching also had a positive effect on improving the electrical properties of diced varistors. However, it took NaOH 1.5 hours to produce results comparable to those obtained by 10 minutes of citric acid etching.

The foregoing detailed description of the invention includes passages which are chiefly or exclusively concerned with particular parts or aspects of the invention. It is to be understood that this is for clarity and convenience, that a particular feature may be relevant in more than just passage in which it is disclosed, and that the disclosure herein includes all the appropriate combinations of information found in the different passages. Similarly, although the various figures and descriptions thereof relate to specific embodiments of the invention, it is to be understood that where a specific feature is disclosed in the context of a particular figure, such feature can also be used, to the extent appropriate, in the context of another figure, in combination with another feature, or in the invention in general.

What is claimed is:

1. A method of making varistor chips, comprising the steps of:

(a) providing a workpiece of varistor material, the varistor material having an average grain size;

(b) slicing the workpiece into a plurality of slices of varistor material, the slices having two laminar surfaces;

(c) electroding at least one laminar surface of the slices of varistor material;

(d) thereafter dicing the electroded slices into a plurality of varistor chips; and (e) etching the chips with an etchant to remove varistor material damaged during the slicing and/or dicing steps.

2. A method according to claim 1, wherein the varistor material comprises a primary metal oxide and at least one additive metal oxide and wherein zinc oxide is the primary metal oxide and the at least one additive metal oxide is selected from the group consisting of $Al_2O_3$, $B_2O_3$, BaO, $Bi_2O_3$, CaO, CoO, $Co_3O_4$, $Cr_2O_3$, FeO, $In_2O_3$, $K_2O$, MgO, $Mn_2O_3$, $Mn_3O_4$, $MnO_2$, NiO, PbO, $Pr_2O_3$, $Sb_2O_3$, $SiO_2$, SnO, $SnO_2$, SrO, $Ta_2O_5$, and $TiO_2$.

3. A method according to claim 1, wherein the etchant is selected from the group consisting of citric, nitric, acetic, hydrochloric, perchloric, sulfuric, succinic, ethylene diamine tetraacetic, and oxalic acids.

4. A method according to claim 1, wherein the etchant is sodium or potassium hydroxide.

5. A method according to claim 1, wherein both laminar surfaces are electroded.

6. A method according to claim 1, wherein the electroding is done by plasma spraying a conductor, by silk screening a conductive ink, or by vacuum depositing a conductor.

7. A method according to claim 1, wherein the varistor chips have a leakage current of less than $1\times10^{-7}$ amp/cm$^2$ after the etching step.

8. A method according to claim 1, wherein the varistor chips produced have a variation in switching voltage of less than ±2% at a normalized current density of 1 mAmp/cm$^2$.

9. A method according to claim 1, wherein during the etching step a surface thickness of between 10 and 30 μm of varistor material is removed.

10. A method according to claim 9, wherein the surface thickness removed is 20±5 μm.

11. A method according to claim 1, wherein during the etching step a surface thickness equal to the average grain size of the varistor material is removed.

* * * * *